US008985647B2

(12) United States Patent
Kuzelka

(10) Patent No.: US 8,985,647 B2
(45) Date of Patent: Mar. 24, 2015

(54) INTEGRAL HANDLE LOCKING BAND

(75) Inventor: Kenneth J. Kuzelka, Island Lake, IL (US)

(73) Assignee: Michael D. Stolzman, Lake Forest, IL (US)

( * ) Notice: Subject to any disclaimer, the term of this patent is extended or adjusted under 35 U.S.C. 154(b) by 845 days.

(21) Appl. No.: 12/940,216

(22) Filed: Nov. 5, 2010

(65) Prior Publication Data

US 2012/0112476 A1 May 10, 2012

(51) Int. Cl.
*B65D 45/30* (2006.01)
*B65D 45/34* (2006.01)

(52) U.S. Cl.
CPC ..... *B65D 45/345* (2013.01)
USPC ..... 292/256.65; 292/256.69

(58) Field of Classification Search
CPC ..... B65D 2543/00972; E05B 65/006; F16J 13/02; F16J 13/06; F16J 13/065; F16J 15/46
USPC ..... 292/256, 256.5, 256.6, 256.65, 256.67, 292/256.71, 256.73
See application file for complete search history.

(56) References Cited

U.S. PATENT DOCUMENTS

| | | | | |
|---|---|---|---|---|
| 360,770 | A | 4/1887 | Gardner | |
| 2,579,975 | A * | 12/1951 | Scott et al. | 292/256.69 |
| 3,070,397 | A | 12/1962 | Rodish | |
| 3,261,632 | A | 7/1966 | Schaefer | |
| 3,458,217 | A | 7/1969 | Pride, Jr. et al. | |
| 3,556,575 | A | 1/1971 | Farkas | |
| 3,637,257 | A * | 1/1972 | Uncapher | 292/256.69 |
| 3,790,020 | A | 2/1974 | Fine | |
| 3,861,723 | A | 1/1975 | Kunz et al. | |
| 3,897,884 | A | 8/1975 | Lankenau | |
| 4,197,982 | A | 4/1980 | de Lima Castro Netto | |
| 5,026,360 | A * | 6/1991 | Johnsen et al. | 604/338 |
| 5,085,476 | A | 2/1992 | Fuehrer | |
| 5,129,537 | A * | 7/1992 | Bordner et al. | 220/321 |
| 5,299,707 | A * | 4/1994 | Stolzman | 220/321 |
| 5,713,482 | A * | 2/1998 | Bordner et al. | 220/321 |
| 5,785,201 | A | 7/1998 | Bordner et al. | |
| 5,947,320 | A | 9/1999 | Bordner et al. | |
| 6,126,213 | A | 10/2000 | Jones et al. | |
| 6,712,542 | B2 | 3/2004 | Buder | |
| 7,243,962 | B2 * | 7/2007 | Stolzman | 292/256.69 |
| 7,497,489 | B2 * | 3/2009 | Baughman et al. | 292/256.65 |
| 7,802,827 | B2 * | 9/2010 | Easterday et al. | 292/256 |
| 2007/0102941 | A1 * | 5/2007 | Easterday et al. | 292/256.69 |
| 2008/0079265 | A1 * | 4/2008 | Baughman et al. | 292/256.65 |

* cited by examiner

*Primary Examiner* — Carlos Lugo
*Assistant Examiner* — Faria Ahmad
(74) *Attorney, Agent, or Firm* — Wood, Phillips, Katz, Clark & Mortimer

(57) ABSTRACT

A locking band for use with a container having an annular end portion defining a top opening and a removable cover overlying said opening. The locking band comprises a split circular ring, generally U-shaped in cross section, having first and second ends and including an outer circumferential wall. The second end is of a larger size than the first end to define a handle. A first notch opens outwardly proximate the first end and a second notch opens inwardly proximate the second end. Circumferential spacing between the notches is a select amount greater than a circumference of a cover. A band link has a first end and a second end, each end including a shaft receivable in the respective first and second notches. Spacing between the shafts is substantially similar to the select amount. In use, with the split circular ring surrounding the removable cover and annular end portion, the handle is forced inwardly toward the first end until the handle overlies the first end to secure the cover on the container.

18 Claims, 7 Drawing Sheets

INTEGRAL HANDLE LOCKING BAND

FIELD OF THE INVENTION

This invention relates to containers and, more particularly, to an integral handle plastic locking band for securing a cover to a container.

BACKGROUND OF THE INVENTION

In one form of conventional shipping and storage container, in the form of a drum, a tubular side wall is formed of fibrous material or other material. It is conventional to provide connecting rings at opposite ends of the sidewall for securing closures there across. The connecting rings may be of metal or plastic. Alternatively, the drum may be of one piece plastic construction, such as made by blow molding.

In one form of a container closure, a removable cover is configured to rest on the annular connecting ring at the top of the container. A locking band secures the cover to the retaining ring. The locking band most commonly has been formed of metal and includes metal locking structure riveted thereto. Such a metal locking band can be expensive and might also rust, which could contaminate the product stored in the container. Locking bands have also been formed of plastic.

The present invention is directed to solving one or more of the problems discussed above in a novel and simple manner.

SUMMARY OF THE INVENTION

In accordance with one aspect of the invention, there is disclosed a locking band for use with a container having an annular end portion defining a top opening and a removable cover overlying the opening. The locking band comprises a split circular ring, generally U-shaped in cross section, having first and second ends and including an outer circumferential wall. The second end is of a larger size than the first end to define a handle. A first notch opens outwardly proximate the first end and a second notch opens inwardly proximate the second end. Circumferential spacing between the notches is a select amount greater than a circumference of a cover. A band link has a first end and a second end, each end including a shaft receivable in the respective first and second notches. Spacing between the shafts is substantially similar to the select amount. In use, with the split circular ring surrounding the removable cover and annular end portion, the handle is forced inwardly toward the first end until the handle overlies the first end to secure the cover on the container.

It is a feature of the invention to provide locking structure operatively associated with the split circular ring for retaining the handle overlying the first end.

The locking structure may comprise an elongate hook extending outwardly from the outer circumferential wall spaced from the first end and an opening through the outer circumferential wall between the second notch and the second end. The elongate hook is selectively captured in the opening incident to the handle overlaying the first end to lock the band on the container.

It is a further feature of the invention that the elongate hook extends circumferentially along the circumferential wall and deflects downwardly as it is being captured in the opening.

It is still another feature of the invention that the elongate hook comprises a finger having a notch defining a shoulder and a ramped portion outwardly of the shoulder to facilitate insertion in the opening whereby the shoulder engages the handle at the opening to retain the handle overlaying the first end.

It is another feature of the invention that the locking structure comprises a twist lock including a T-shaped member connected to and extending outwardly from the outer circumferential wall spaced from the first end and an elongate opening through the outer circumferential wall between the second notch and the second end. The T-shaped member is selectively captured in the elongate opening incident to the handle overlaying the first end to lock the band on the container.

It is yet another feature of the invention that the T-shaped member is pivotally connected to the outer circumferential wall.

It is still a further feature of the invention that the handle is nested on the first end incident to the handle overlying the first end.

It is still another feature of the invention that the split circular ring includes a first support extending outwardly from the outer circumferential wall proximate the first end, the first support having a transverse opening to define the first notch, and the split circular ring includes a second support extending inwardly from the outer circumferential wall proximate the second end, the second support having a transverse opening to define the second notch. The transverse openings have a narrowed portion to capture the respective shafts therein There is disclosed in accordance with another aspect of the invention a plastic locking band for use with a container having an annular end portion defining a top opening and a removable cover overlying the opening. The locking band comprises a split circular plastic ring, generally U-shaped in cross section, having first and second ends and including an outer circumferential wall. The second end is of a larger size than the first end to define a handle. A first support on an outside of the outer circumferential wall proximate the first end defines a first notch opening and a second support on an inside of the outer circumferential wall proximate the second end defines a second notch opening. Circumferential spacing between the notch openings is a select amount greater than a circumference of the cover. A band link has a first end and a second end, each end including a shaft receivable in the respective first and second notch openings, spacing between the shafts being substantially similar to the select amount. In use, with the split circular ring surrounding the removable cover and annular end portion, the handle is forced inwardly toward the first end until the handle overlies the first end to secure the cover on the container.

It is a feature of the invention that the band link comprises a pair of elongate parallel plates having the first and second shafts extending therebetween at opposite ends. The band link may further comprise a plurality of ribs connecting the elongate parallel plates.

Further features and advantages of the invention will be readily apparent from the specification and from the drawings.

DETAILED DESCRIPTION OF THE INVENTION

Figure 1:
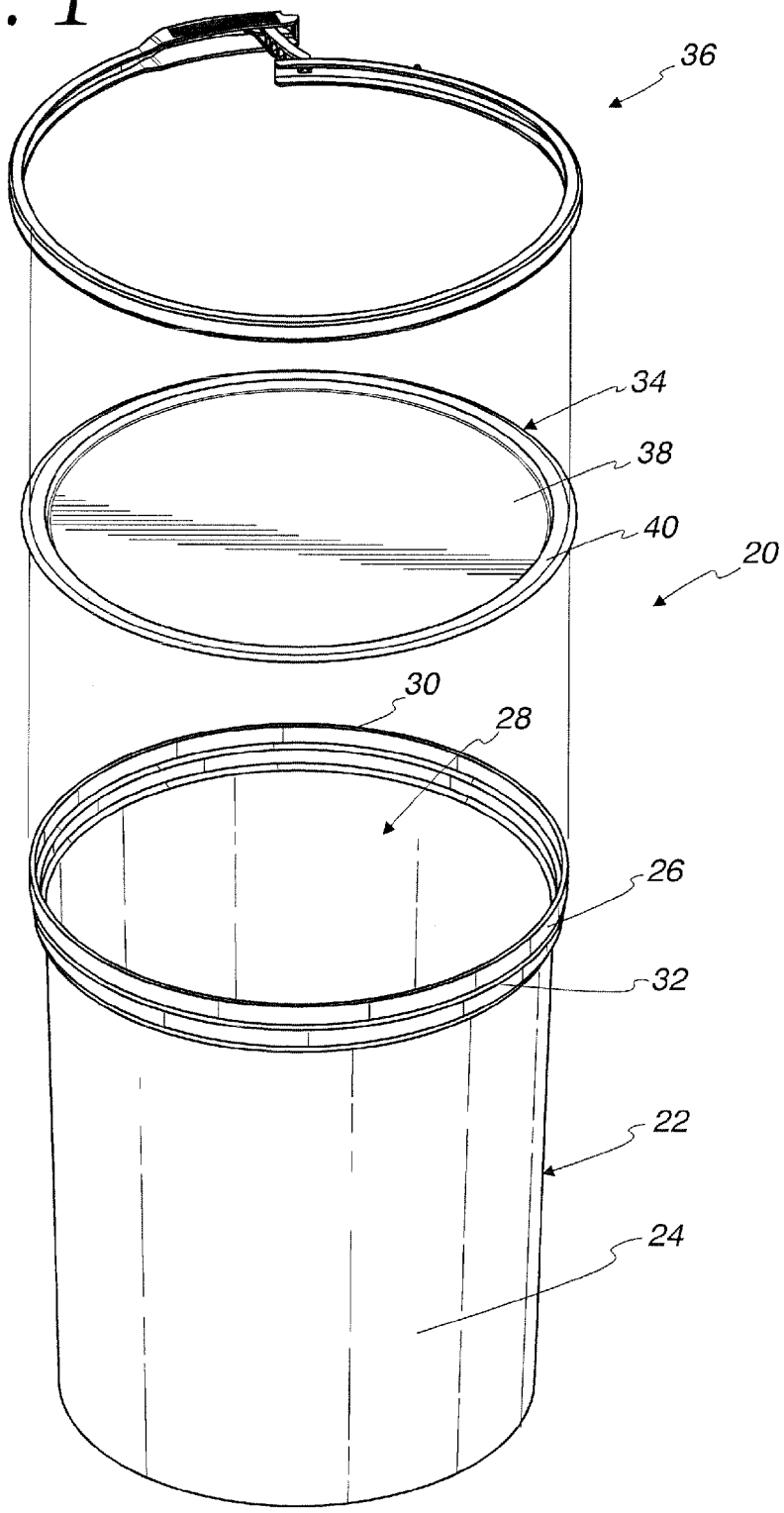
FIG. 1 is an exploded perspective view of a container including a drum, cover and locking band in accordance with a first embodiment of the invention.
Figure 7:
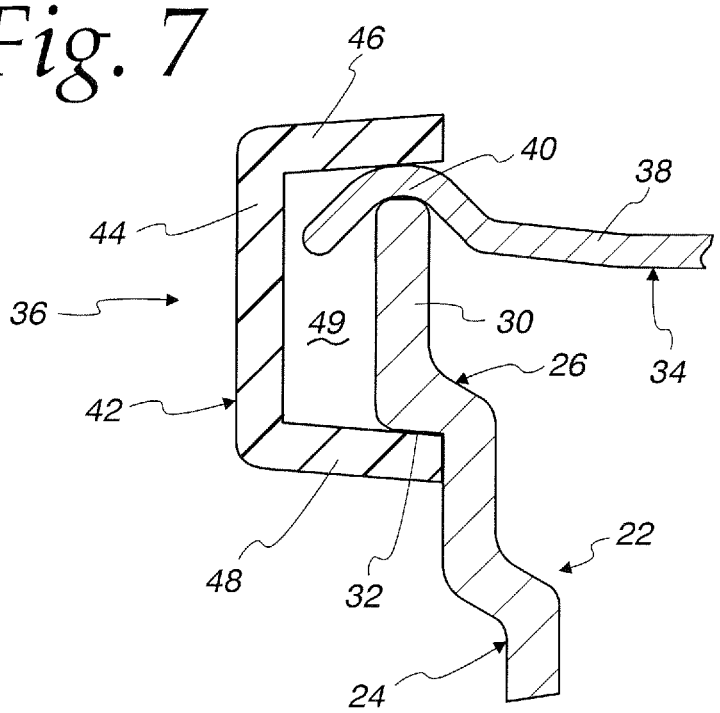
FIG. 7 is a sectional view illustrating the locking belt retaining the cover on the container.

In a first illustrated embodiment of the invention, as shown in FIG. 1, a container 20 includes a drum 22 having a tubular side wall 24 closed at a bottom by a bottom wall (not shown) and having an annular end portion 26 defining a top opening 28. The annular end portion 26 comprises a connecting ring in the form of a chime 30. In the illustrated embodiment of the invention, the drum 20 is of one piece molded plastic construction such as may be formed by blow molding. Referring also to FIG. 7, the chime 30 defines an annular shoulder 32.

As an alternative to a one piece plastic drum, the drum 22 may be formed of other materials such as a conventional fibrous tube side wall having a metal or plastic connecting ring defining a radially outwardly opening annular recess to define a shoulder similar to the shoulder 32.

The top opening 28 is selectively closed by a cover or closure 34 secured to the chime 30 using a locking band 36 according to the invention. The closure 34 is of unitary construction and in the illustrated embodiment is injection molded of suitable synthetic resin. The closure 34 includes a generally circular top wall 38 surrounded by a downwardly opening U-shaped flange 40. When the closure 34 is seated on the chime 30, the chime 30 is received in the flange 40, as illustrated in FIG. 7.

Figure 2:
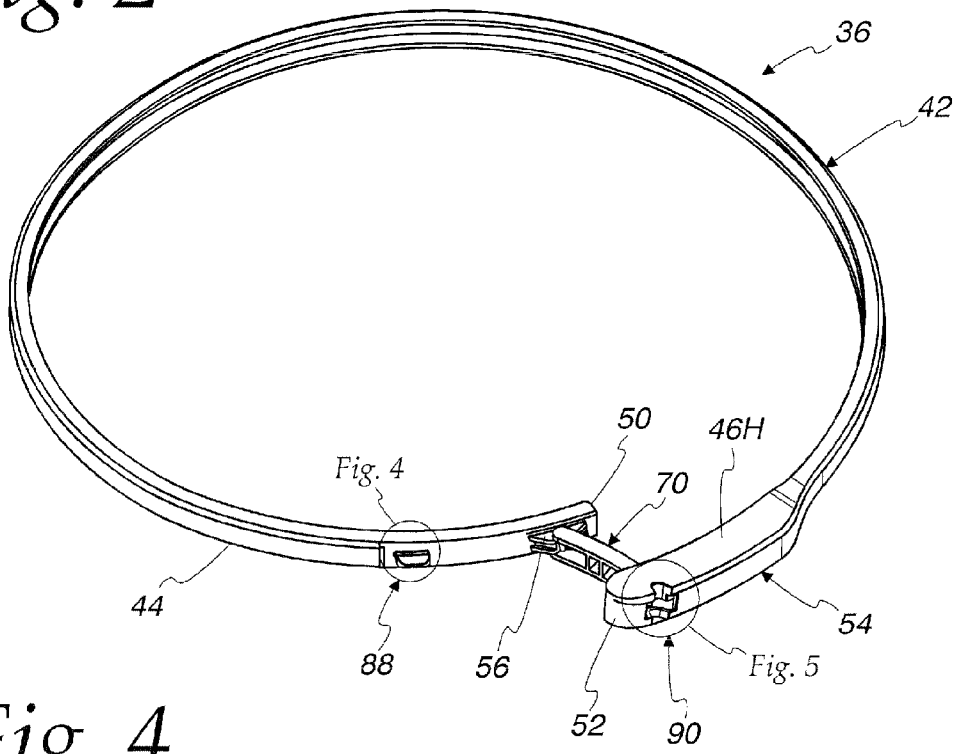
FIG. 2 is a perspective view of the locking band of FIG. 1 in an open configuration.

The locking band 36 includes a split circular ring 42, see FIG. 2. The split circular ring 42 is generally U-shaped in cross section, as shown in FIG. 7, including an outer circumferential wall 44 separating an upper wall portion 46 and a lower wall portion 48. The U-shaped split circular ring 42 defines a channel 49. In use, the outer circumferential wall 44 extends around the closure 34 with the lower wall portion 48 engaging the drum shoulder 32 and the upper wall portion 46 projecting radially inwardly above the closure flange 40 to retain the closure 34 on the drum 22. Particularly, the upper wall portion 46 and the chime 30 sandwich the flange 40. A gasket (not shown) may be included in the flange 40.

The ring 42 has a first end 50 and an opposite second end 52. The ring 42 is larger proximate the second end 52 to define a handle 54. Particularly, the spacing between an upper wall portion 46H and a lower wall portion 48H, see FIG. 9, at the handle 54 is greater than normal spacing between the upper wall portion 46 and lower wall portion 48, as is evident in FIG. 2. More particularly, the inside spacing between the portions 4611 and 48H is greater than outside spacing between the normal portions 46 and 48 so that the handle 54 nests on ring first end 50 incident to the handle 54 overlying the first end 50 to lock the band 36 on the container 20, as described below and shown in FIG. 6. The handle wall portions 46H and 48H are also deeper than the corresponding wall portions 46 and 48 to also provide room for the first end 50.

Figure 9:
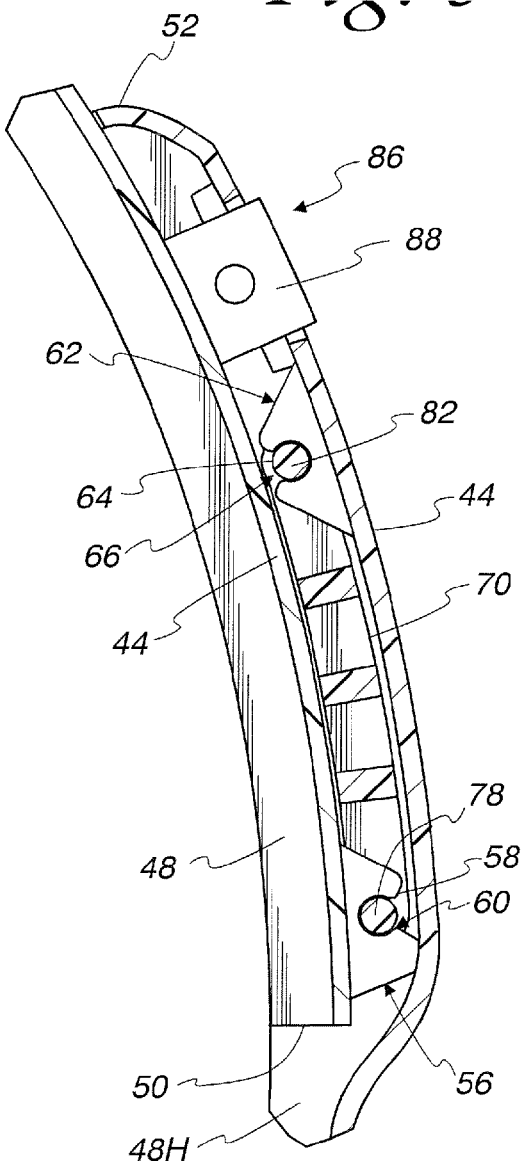
FIG. 9 is a sectional view taken along the line 9-9 of FIG. 6.

Referring also to FIG. 9, a first support 56 extends radially outwardly from the outer circumferential wall 44 proximate the first end 50. The first support 56 includes a transverse opening 58 to define a first notch 60. The transverse opening 58 is generally circular in cross section, having a radial opening defining the notch 60 less than the diameter of the transverse opening 58. The first notch 60 opens outwardly relative to the outer circumferential wall 44.

A second support 62 extends radially inwardly from the outer circumferential wall 44 proximate the second end 52. Particularly, the second support 62 is located within the handle 54. The second support 62 includes a second transverse opening 64, similar to the first transverse opening 58, defining a second notch 66. The second notch 66 opens inwardly relative to the outer circumferential wall 44. The second transverse opening 64 is also circular and has a narrowed portion at the notch 66, as with the first support 56.

As described above, with the locking band 36 securing the cover 34 to the drum 22, the handle 54 overlies the first end 50. As such, the length of the ring 42 from the first end 50 to the second end 52 is greater than the circumference of the cover 34. In accordance with the invention, circumferential spacing between the first notch 60 and the second notch 66 is a select amount greater than a circumference of the cover 34. This select amount may be on the order of 3 to 4 inches.

Figure 3:
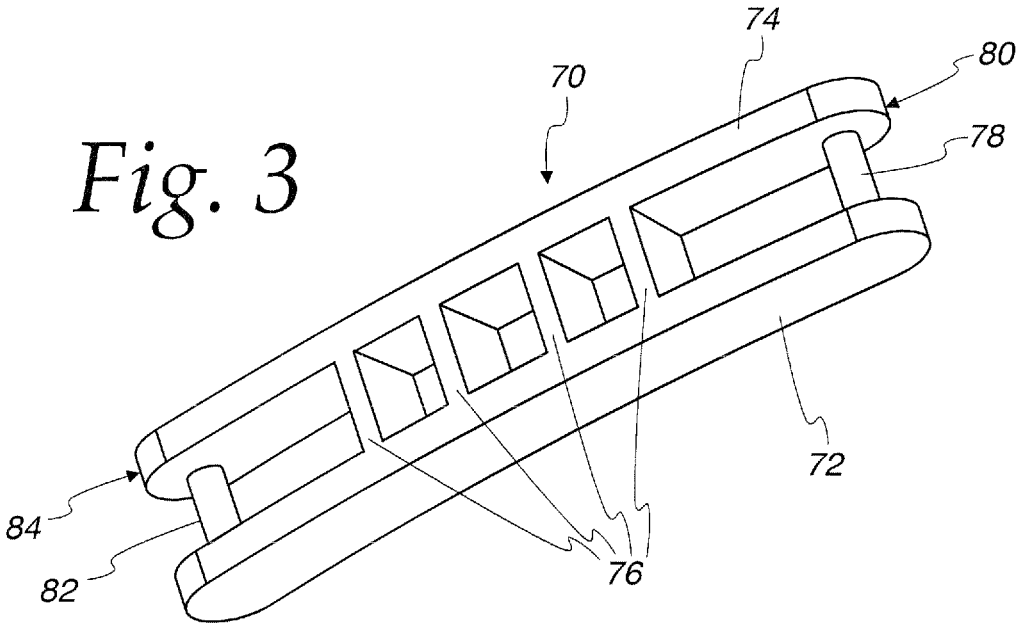
FIG. 3 is a perspective view of a band link of the locking band of FIG. 2.

Referring back to FIG. 2, the locking band 36 also comprises a band link 70. The band link 70 is shown in greater in FIG. 3. The band link 70 comprises elongate, slightly arcuate, parallel plates 72 and 74. The plates 72 and 74 have a radius corresponding generally to a radius of the cover 34. A plurality of ribs 76 connects the parallel plates 72 and 74. A first shaft 78 extends between the plates 72 and 74 at a first end 80 of the band link 70. A second shaft 82 extends between the plates 72 and 74 at a second end 84 of the band link 70.

The shafts 78 and 82 are cylindrical and have a diameter slightly less than a diameter of the support transverse openings 58 and 64 but greater than the narrowed portion defining the respective notches 60 and 66. The shafts 78 and 82 are removably receivable in the respective first notch 60 and second notch 66, as generally illustrated in FIG. 9. Spacing between the shafts 78 and 82 is substantially similar to the previously described select amount that the circumferential spacing between the notches 60 and 66 is greater than a circumference of the cover 34.

Figure 8:
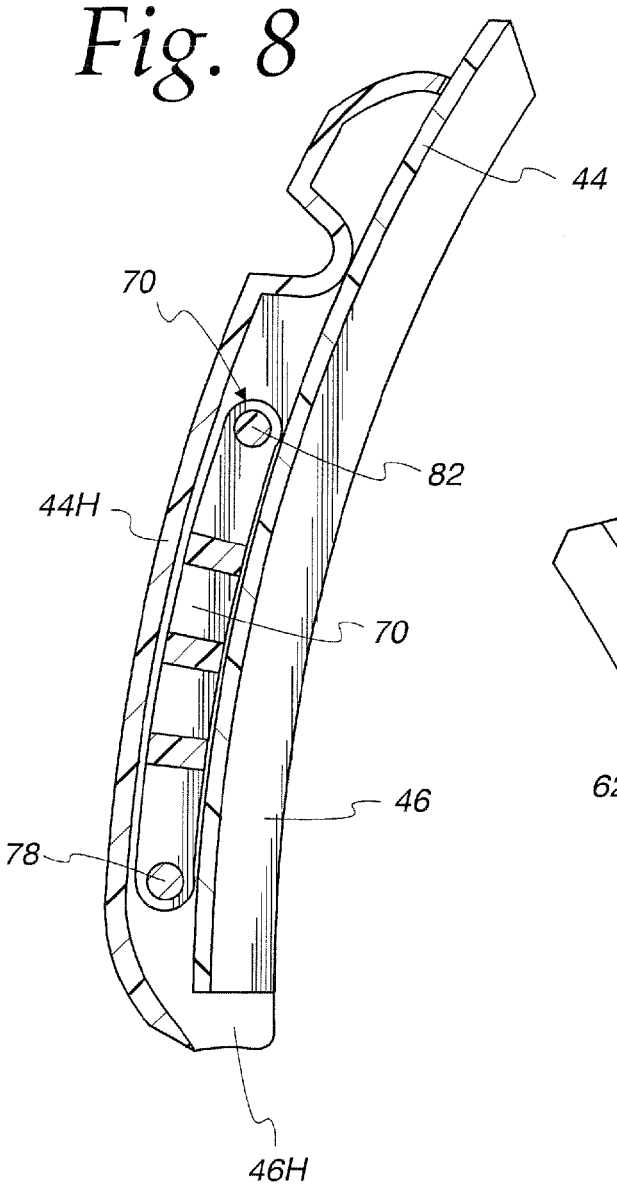
FIG. 8 is a sectional view taken along the line 8-8 of FIG. 6.

To install the locking band 36 onto the drum 22 and closure 34, the split circular ring 42 is placed around the closure 34 and chime 30, as generally illustrated in FIG. 7, with the first end 50 and second end 52 spaced radially apart as shown in FIGS. 1 and 2. As such, the first end 50 is generally in contact with the closure 34, while the handle 54 is spaced radially therefrom. The handle 54 is initially moved in a direction which will tighten the locking band 36 so that the band link 70 is in an over centered position. Thereafter, the handle 54 is pushed inwardly toward the container 20. As the handle 54 moves inwardly, the band link 70 pivots in the notches 60 and 66 gradually forcing the second end 52 circumferentially away from the first end 50 until the handle 54 is nested over the first end 50, as illustrated in FIGS. 8 and 9.

Figure 10:
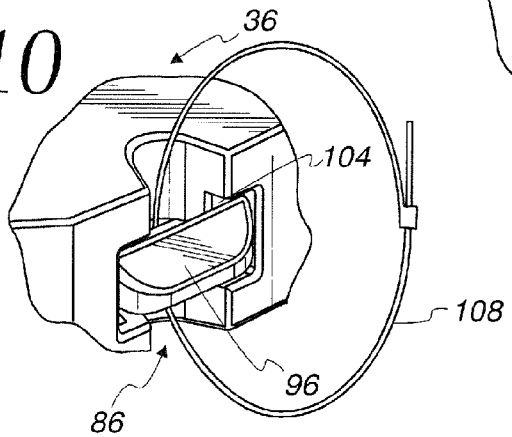
FIG. 10 is a detailed view illustrating the locking structure for the locking band of FIG. 10 with a tamper evident locking element.

The locking band 36 comprises locking structure 86 shown in FIG. 10. The locking structure 86 retains the handle 54 overlying the first end 50. The locking structure 86 comprises a thumb hook, see FIGS. 2 and 4, and a receptacle 90, see FIGS. 2 and 5.

Figure 4:
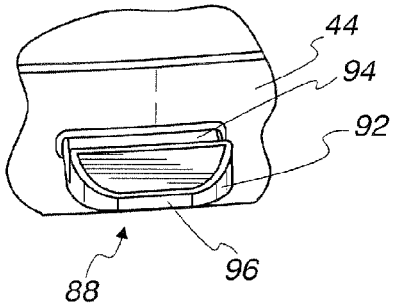
FIG. 4 is a detailed view taken from FIG. 2 illustrating a thumb lock.
Figure 5:
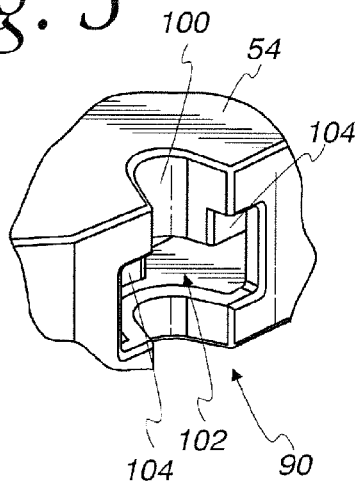
FIG. 5. is a detailed view taken from FIG. 2 illustrating a thumb lock receptacle.
Figure 6:
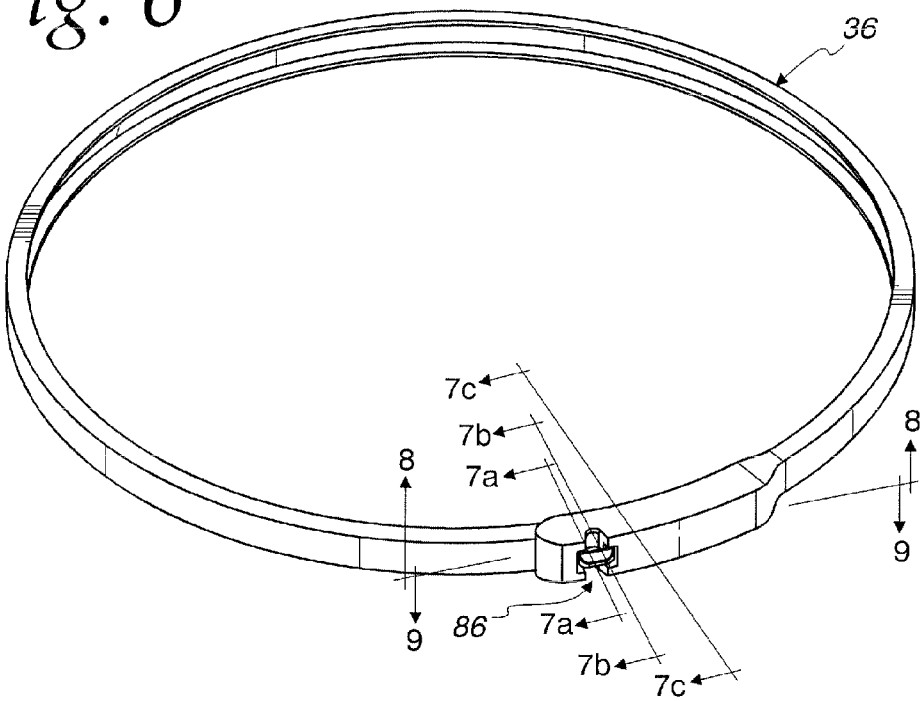
FIG. 6 is a perspective view of the locking band of FIG. 2 in a locked configuration.

The thumb hook 88 extends outwardly from the outer circumferential wall 44 spaced from the first end 50. The spacing is sufficient so that it is received just within the handle 54 with the locking band in the closed configuration as shown in FIG. 6. Referring particularly to FIG. 4, the thumb hook 88 comprises an elongate tab 92 extending circumferentially along the outer circumferential wall 44. The tab 92 includes a neck 94 connecting a head 96 to the outer circumferential wall 44 to define a shoulder 98, see FIGS. 7*a* and 7*b*. The head 96 narrows outwardly from the shoulder 98.

The receptacle 90 comprises a transverse semi-cylindrical inset 100. A generally rectangular opening 102 extends circumferentially intersecting the inset 100. Opposite shoulders 104 are just above the opening 102 on either side of the inset 100. The opening 102 is of a size to receive the thumb hook head 96.

Figure 7A:
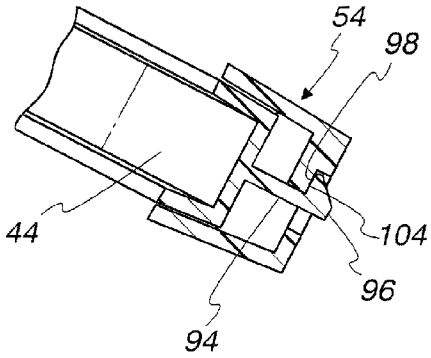
FIG. 7*a* is a detailed view taken along the line 7*a*-7*a* of FIG. 6.
Figure 7B:
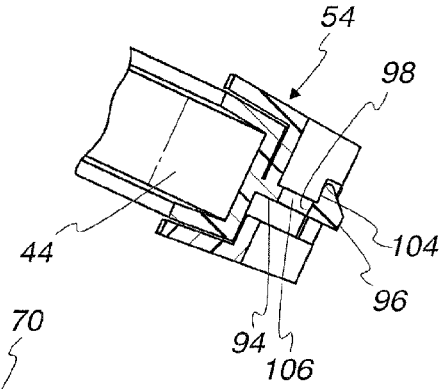
FIG. 7*b* is a sectional view taken along the line 7*b*-7*b* of FIG. 6.
Figure 7C:
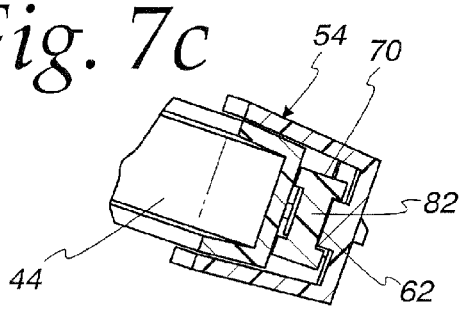
FIG. 7*c* is a sectional view taken along the line 7*c*-7*c* of FIG. 6.

When the locking band handle 54 is moved to the nested position shown in FIG. 6, and as discussed above, the thumb hook 96 abuts a back side of the inset 100. This causes the thumb hook 88 to deflect downwardly owing to the angled surface of the head 96. Once the head 96 extends past the receptacle shoulders 104, the thumb hook 88 returns to its non-deflected configuration with the thumb hook shoulder 98 engaging the receptacle shoulder 104, as shown in FIGS. 7*a*, 7*b* and 10. The neck 94 includes an opening 106, see FIG. 7*b*. In the locked position, the opening 106 is positioned within the inset 100 and can receive a locking element 108 to provide a tamper evident lock.

To release the lock, the user depresses the head 96 so that the head 96 clears the shoulders 104. Thereafter, the handle 54 can be pulled outwardly, as is apparent.

Figure 11:
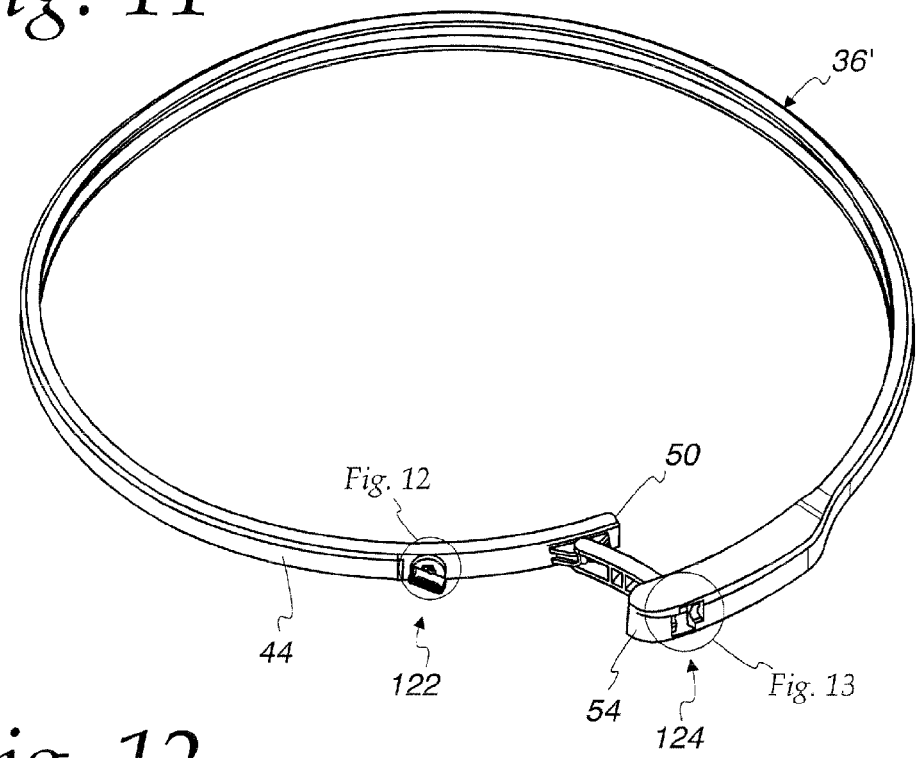
FIG. 11 is a perspective view of a locking band in accordance with a second embodiment of the invention in an open configuration.
Figure 12:
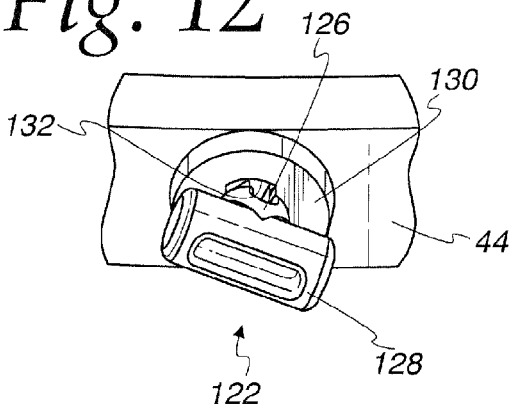
FIG. 12 is a detailed view illustrating a twist lock of the locking band of FIG. 11.

Referring to FIG. 11, a locking band 36' according to a second embodiment of the invention is illustrated. The locking band 36' is generally similar to the locking band 36, discussed above, except that it uses an alternative locking structure 120. For simplicity, the locking band 36' is referenced with identical reference numerals for elements identical to those with the locking band 36. The locking structure 120 comprises a twist lock configuration including a T-shaped member 122, see FIGS. 11 and 12, connected to and extending outwardly from the outer circumferential wall 44 spaced from the first end 50. A lock receptacle 124, see FIGS. 11 and 13, is positioned proximate the second end 54.

Figure 17:
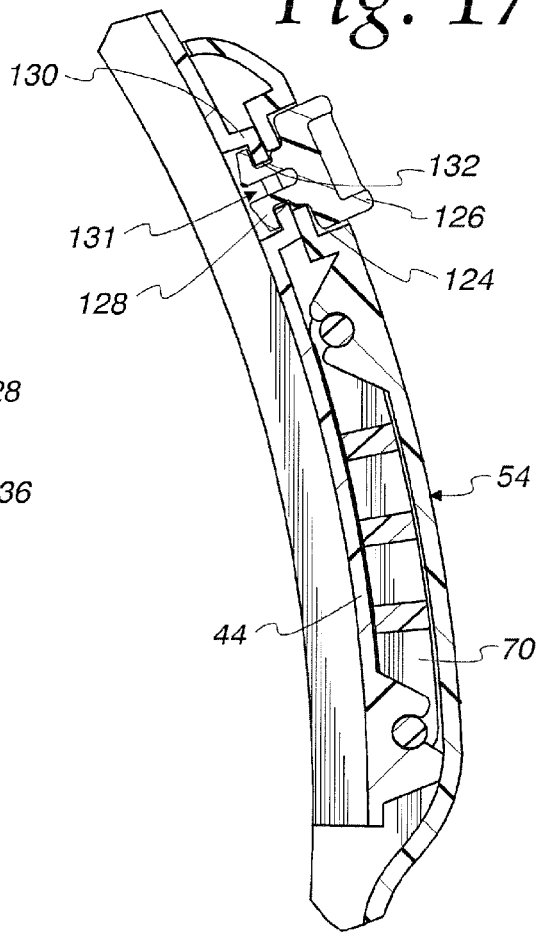
FIG. 17 is a sectional view taken along the line 17-17 of FIG. 15.

The T-shaped member has a cylindrical neck 126 connected to a cylindrical head 128 in a T configuration. An underside of the neck 124 is connected to a shoulder 128, see FIG. 17. The neck 124 and shoulder 128 are bifurcated as at 130. A collar 132 extends upwardly from the outer circumferential wall 44 and includes a central opening 132. The opening 132 is slightly larger than the neck 126 and smaller than the shoulder 128. The T-shaped member is mounted by pushing the shoulder through the opening 132 causing flexing of the neck 126 owing to the bifurcation 130 until it is captured in the opening 132 as shown particularly in FIG. 17. As such, the T-shaped member 122 is pivotally connected to the collar 130.

Figure 13:
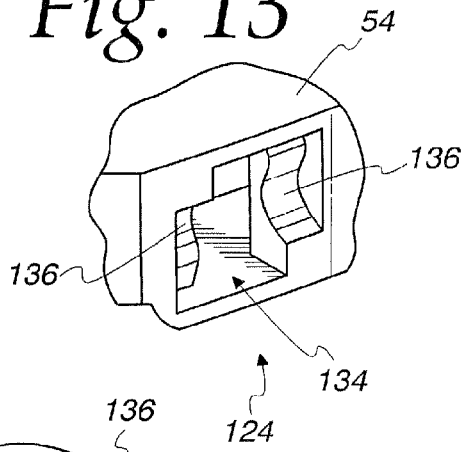
FIG. 13 is a detailed view illustrating a twist lock receptacle of the locking band of FIG. 11.

Referring to FIG. 13, the handle 54 includes a transverse opening 134 of a size larger than the twist lock head 128. A semi-cylindrical valley 136 is provided on either side of the opening 134.

Figure 14:
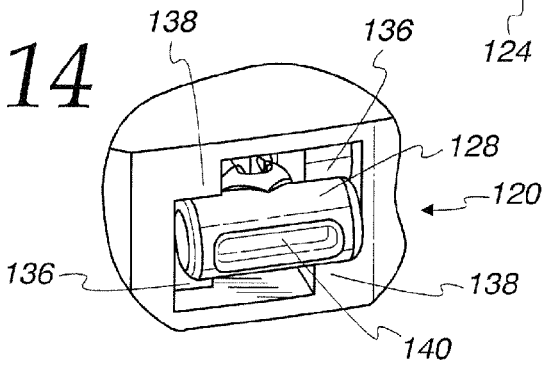
FIG. 14 is a detailed view illustrating the locking structure in a locked configuration.
Figure 15:
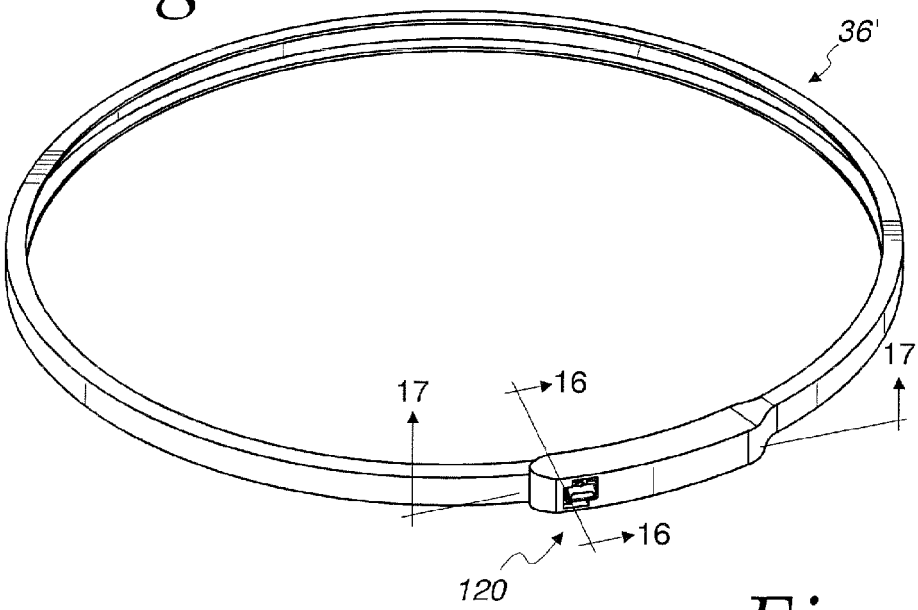
FIG. 15 is a perspective view of the locking band of FIG. 11 in a locked configuration.
Figure 16:
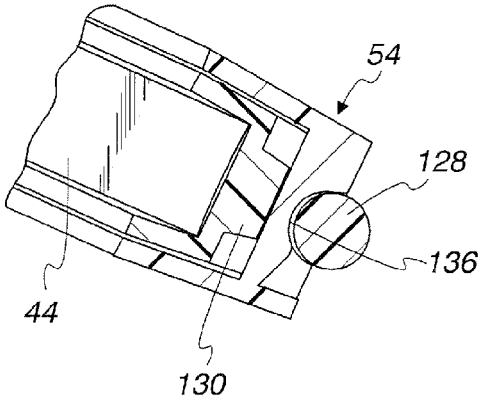
FIG. 16 is a sectional view taken along the line 16-16 of FIG. 15.

When the locking band 36' is moved from the open position, see FIG. 11, to the locked position, see FIG. 15, the twist lock head 128 is aligned transversely so that it can pass through the opening 134. The twist lock head 128 is then rotated counterclockwise until the head 128 is received in the valleys 136, as seen in FIG. 14. Stops 138 are provided in opposite corners of the opening 134, as shown in FIG. 14, to prevent over rotation. Thereafter, the twist lock head 128 rests in the defined valleys 136 under tension. To unlock the locking band 36', an anti-clockwise force must be applied to the twist lock head 128 with sufficient force to overcome the ramped surfaces provided by the valleys 136. A groove 140 is provided in the head 128 to allow a straight screwdriver to operate the locking structure 120.

Thus, the locking bands 36 and 36' operate generally similar, except for the use of the different locking structure in each.

Owing to the illustrated construction, even if the band link 70 breaks or is otherwise damaged after installation, the locking structure 86 or 120 retains the locking band 36 or 36' on the container 20. Particularly, the band link 70 is used to provide an appropriate constricting force on the locking band during installation, but is effectively inoperative once the band is in the locked position.

In accordance with the invention, the locking bands are of all plastic construction. Particularly, the split circular ring 42 and band link 70 are both injection molded of synthetic resin such as high load melt index (HLMI) resin.

Because of the configuration of the locking bands 36 and 36', both are bidirectional. As such, the bands can be put on in either orientation so that they function as a left handed locking band or right handed locking band, as necessary, or desired.

Thus, in accordance with the invention, there is provided an all plastic locking band for securing a closure to a drum to form a shipping and storing container. The locking band includes an integral handle eliminating the requirement for a separate piece for a handle. The handle side walls can be knurled for ease of operation. While the locking band is of all plastic construction, the band can be used on all drum types, namely fiber, plastic, steel or composite structures.

I claim:

1. A locking band for use with a container having an annular end portion defining a top opening and a removable cover overlying said opening, comprising:

a split circular ring, generally U-shaped in cross section, having first and second ends and including an outer circumferential wall, the second end being of a larger size than the first end to define a handle, a first notch opens outwardly proximate the first end and a second notch opens inwardly proximate the second end, circumferential spacing between the notches being a select amount greater than a circumference of the cover; and a band link having a first end and a second end, each end including a shaft receivable in the respective first and second notches, spacing between the shafts being substantially similar to the select amount;

wherein, in use, with the split circular ring surrounding the removable cover and annular end portion, the handle is forced inwardly toward the first so that the second notch passes over said first notch end until the handle overlays the first end to secure the cover on the container.

2. The locking band of claim 1 further comprising locking structure operatively associated with the split circular ring for retaining the handle overlaying the first end.

3. The locking band of claim 2 wherein the locking structure comprises an elongate hook extending outwardly from the outer circumferential wall spaced from the first end and an opening through the outer circumferential wall between the second notch and the second end, the elongate hook being selectively captured in the opening incident to the handle overlaying the first end to lock the band on the container.

4. The locking band of claim 3 wherein the elongate hook extends circumferentially along the outer circumferential wall and deflects downwardly as it is being captured in the opening.

5. The locking hand of claim 4 wherein the elongate hook comprises a neck connecting an enlarged head to the outer circumferential wall to define a shoulder and the head narrows outwardly of the shoulder to facilitate insertion in the opening whereby the shoulder engages the handle at the opening to retain the handle overlaying the first end.

6. The locking band of claim 2 wherein the locking structure comprises a twist lock including a T-shaped member connected to and extending outwardly from the outer circumferential wall spaced from the first end and an elongate opening through the outer circumferential wall between the second notch and the second end, the T-shaped member being selectively captured in the elongate opening incident to the handle overlaying the first end to lock the band on the container.

7. The locking band of claim 6 wherein the T-shaped member is pivotally connected to the outer circumferential wall.

8. The locking band of claim 1 wherein the split circular ring includes a first support extending outwardly from the outer circumferential wall proximate the first end, the first support having a transverse opening to define the first notch, and the split circular ring includes a second support extending inwardly from the outer circumferential wall proximate the second end, the second support having a transverse opening to define the second notch.

9. The locking band of claim 8 wherein the transverse openings have a narrowed portion to capture the respective shafts therein.

10. The locking band of claim 1 wherein the handle is nested on the first end incident to the handle overlaying the first end.

11. A plastic locking band for use with a container having an annular end portion defining a top opening and a removable cover overlying said opening, comprising:

a split circular plastic ring, generally U-shaped in cross section, having first and second ends and including an outer circumferential wall, the second end being of a larger size than the first end to define a handle, a first support on an outside of the outer circumferential wall proximate the first end defining a first notch opening and a second support on an inside of the outer circumferential wall proximate the second end defining a second notch opening, circumferential spacing between the notch openings being a select amount greater than a circumference of the cover; and a band link having a first end and a second end, each end including a shaft receivable in the respective first and second notch openings, spacing between the shafts being substantially similar to the select amount;

wherein, in use, with the split circular ring surrounding the removable cover and annular end portion, the handle is forced inwardly toward the first end so that the second notch passes over the first notch until the handle overlays the first end to secure the cover on the container.

12. The locking band of claim 11 further comprising locking structure operatively associated with the split circular ring for retaining the handle overlaying the first end.

13. The locking band of claim 12 wherein the locking structure comprises an elongate hook extending outwardly from the outer circumferential wall spaced from the first end and an opening through the outer circumferential wall between the second notch and the second end, the elongate hook being selectively captured in the opening incident to the handle overlaying the first end to lock the band on the container.

14. The locking band of claim 13 wherein the elongate hook extends circumferentially along the outer circumferential wall and deflects downwardly as it is being captured in the opening.

15. The locking band of claim 14 wherein the elongate hook comprises a neck connecting an enlarged head to the outer circumferential wall to define a shoulder and the head narrows outwardly of the shoulder to facilitate insertion in the opening whereby the shoulder engages the handle at the opening to retain the handle overlaying the first end.

16. The locking band of claim 12 wherein the locking structure comprises a twist lock including a T-shaped member connected to and extending outwardly from the outer circumferential wall spaced from the first end and an elongate opening through the outer circumferential wall between the second notch and the second end, the T-shaped member being selectively captured in the elongate opening incident to the handle overlaying the first end to lock the band on the container.

17. The locking band of claim 16 wherein the T-shaped member is pivotally connected to the outer circumferential wall.

18. The locking band of claim 11 wherein the handle is nested on the first end incident to the handle overlaying the first end.

* * * * *